United States Patent [19]

Yianilos

[11] Patent Number: 4,982,181

[45] Date of Patent: Jan. 1, 1991

[54] ALPHANUMERIC DISPLAY

[75] Inventor: Peter N. Yianilos, Fort Lauderdale, Fla.

[73] Assignee: Franklin Electronic Publishers, Incorporated, Mt. Holly, N.J.

[21] Appl. No.: 386,279

[22] Filed: Jul. 28, 1989

[51] Int. Cl.[5] ..... G09G 3/04

[52] U.S. Cl. ..... 340/756; 340/752; 340/765

[58] Field of Search ..... 340/756, 752, 765, 760, 340/762; 40/447, 448

[56] References Cited

U.S. PATENT DOCUMENTS 3,827,043 7/1974 Maezawa ..... 340/756

4,342,031 7/1982 Lapeyre ..... 340/765

*Primary Examiner*—Jeffery A. Brier

*Assistant Examiner*—Xiao Min Wu

*Attorney, Agent, or Firm*—McAulay Fisher Nissen & Goldberg

[57] ABSTRACT

Individual character templates for an alphanumeric display are provided. Each individual character template includes an M row by N column pixel matrix. The M row by N column pixel matrix provides MN pixels. Each of the N columns has a generally vertical shallow "S" shaped format. The pixels along the center rows of the pixel matrix are substantially square and the pixels along the upper and lower rows of the pixel matrix have corners that define a parallelogram and vertical edges that are curved. The template is energized using an electrode trace arrangement which has a plurality of horizontal traces and a plurality of approximately vertical sinuous traces. A segment of each of the vertical tracks within any character template has a shallow "S" shaped form. The first and second columnar trace segments in any given character template is connected to the next to last and last columnar trace segments of the preceding character template and the next lowest row.

6 Claims, 3 Drawing Sheets

ALPHANUMERIC DISPLAY

BACKGROUND OF THE INVENTION

The following invention relates to an alphanumeric display on the screen of an electronic device in which the characters have curvature and to an electrode trace for producing the same.

Dedicated pixel fonts used to create character templates are known in the art. A pixel is the smallest controllable element of a display, and the essence of electronic displays is based upon the ability to turn on and off individual pixels. In most displays the pixels are arranged in an orthogonal array, and each pixel within the orthogonal array is rectilinear. The shape of the pixels, and their orthogonal arrangement may be used to create rectilinear character templates. These rectilinear character templates can be used to portray numbers and letters. However, the numbers and letters portrayed thereon, due to the rectilinear nature of the template, can have no curved portions.

In depicting certain texts it is useful to use characters which have curved portions. Characters with curved portions are useful when one wants to create the look of older print styles such as the print styles penned by scribes which incorporate serifs. These characters, with curved portions, in addition to being aesthetically pleasing enhance the readability of the text being displayed.

Although various electronic technologies can be used with alphanumeric displays, one presently favored technology is the use of liquid crystals. The liquid crystals are activated by applying an electric field. To apply the electric field transparent electrodes made of thin films of tin oxide or metal are used.

The electrodes used to activate liquid crystals are arranged in an orthogonal array. Although this arrangement is sufficient for activating liquid crystals for pixels in an orthogonal array it cannot be used to activate crystals where the pixels will be used to create characters with curved portions. In designing an electronic display and the electrode traces used therewith it is important to achieve the best visual result at the least cost.

Accordingly, it is an object of the present invention, to provide an alphanumeric display which can portray characters with curved portions.

Another object of the present invention is to provide such an alphanumeric display which is no more costly to produce than prior art alphanumeric displays.

Still a further object of the present invention is to provide such a display which is aesthetically pleasing and which enhances readability of text.

BRIEF DESCRIPTION

In one embodiment of the present invention a plurality of individual character templates are deployed in a P row by Q column matrix to provide a character template array for an alphanumeric display. Each individual character template is comprised of a plurality of pixels deployed in an M row by N column matrix. The pixels along the center rows of the matrix are substantially square while the pixels along the upper and lower rows of the matrix have corners that define a parallelogram and vertical edges that are curved. Standard horizontal electrode traces and vertical, "S" shaped electrode traces are used to energize the pixels of the individual character templates.

DETAILED DESCRIPTION OF THE INVENTION

Figure 1:
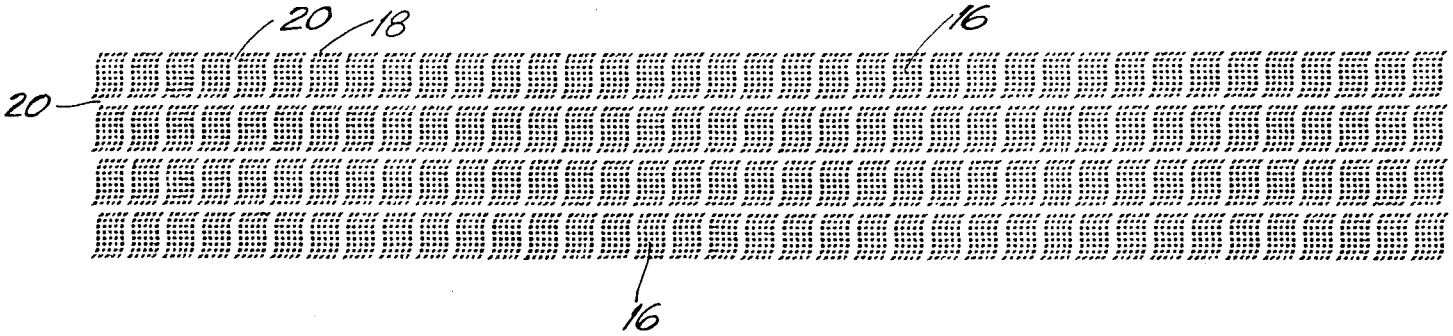
FIG. 1 shows the character template array of the present invention.
Figure 2:
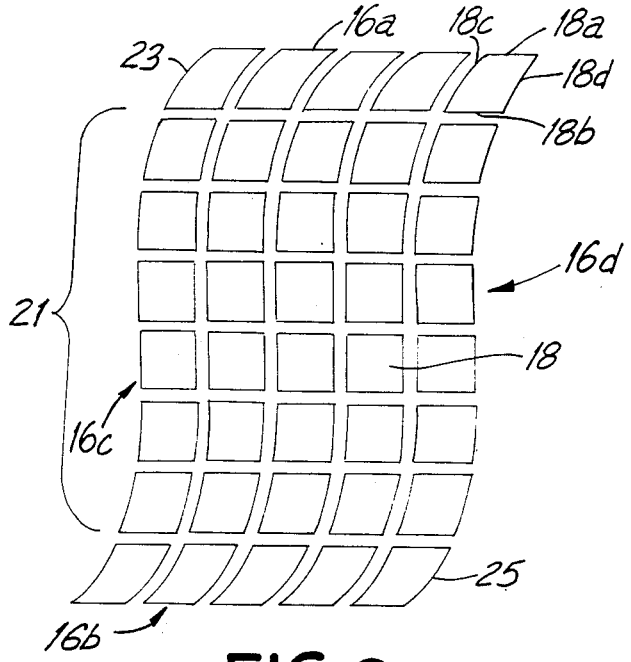
FIG. 2 shows an enlarged view of one of the character templates of FIG. 1.

Referring now to the drawings the reference numeral 10 generally denotes the display screen of the present invention. Upper portion 10*a* of display screen 10 is used to display alphanumeric characters such as character 12. In addition to displaying curved characters such as character 12 the screen may be used to display standard non-curved characters.

Character 12 and the other characters which comprise typeface 14 are created using a plurality of character templates 16. Character templates 16 are each comprised of a plurality of pixels 18. By placing pixels 18 in either an on or off state it is possible to portray different characters on each character template 16.

Character templates 16 are separated from one another by spaces 20 to divide the templates into horizontal template rows and vertical template columns. Using character templates 16 it is possible to portray a wide variety of texts on display screen 10.

The shape of pixels 18 vary and, the positioning of the differently shaped pixels 18 in character templates 16 causes the columns of templates 16 to have a generally vertical "S" shape.

Each character template 16 has parallel, top and bottom straight edges 16*a*, 16*b*. Each character template 16 has parallel, generally "S" curved side edges 16*c* and 16*d*. Each pixel 18 has parallel, top and bottom straight edges 18*a*, 18*b*. Pixels 18 each have parallel side edges 18*c* and 18*d*. The pixels 18 in the center rows 21 of each character template 16 are substantially square with generally straight side edges 18*c*, 18*d*, while the pixels in the upper row 23 and lower row 25 of each character template 16 have corners that define a parallelogram and side edges 18*c*, 18*d* that are curved. When characters having curved segments, such as character 12, are portrayed on screen 10, the curved segment 12*a* of the character is created using the pixels with curved side edges located in the upper row 23 and lower row 25 of the appropriate character template 16.

By providing character templates 16, in an array as shown in FIG. 1, it is possible to portray alphanumeric characters, with curved portions. However the provision of pixels with curved side edges does not preclude the use of center portions of the templates 16 to portray more conventional alphanumeric non-curved characters.

Figure 3:
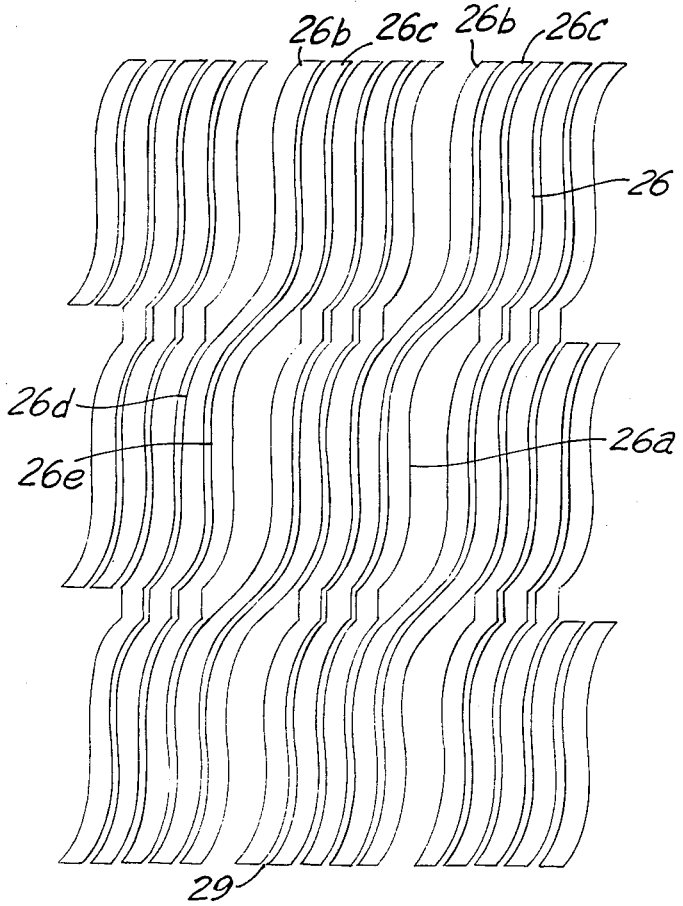
FIG. 3 is a view of a portion of the vertical electrode traces used with the templates of FIG. 1.
Figure 4:
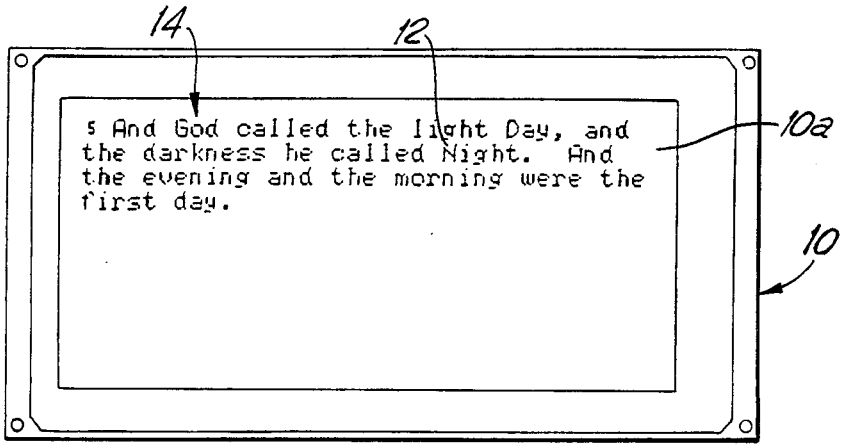
FIG. 4 shows the display screen of the present invention with characters thereon.
Figure 5:
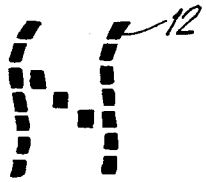
FIG. 5 is an enlarged view of a curved character of the present invention.

Pixels 18 are turned on and off using known liquid crystal technology. To obtain the uniquely shaped character templates 16 of the present invention a unique layout of the vertical electrode traces 26 is used. The horizontal traces (not shown) are conventional straight line traces. As shown in FIG. 3 the vertical electrode traces 26 are sinuous. A segment 26*a* of each vertical electrode 26 has a shallow "S" shaped form. The first and second vertical trace segments 26b, 26c, in any given character template 16 are connected to the next to the last and last sinuous trace segments 26d, 26e of the preceding character template in the next lowest character row. The vertical electrode traces 26, as is conventional in the art, are separated by spaces 29. The vertical traces 26 and the horizontal traces are transparent and may be formed of thin film of tin oxide or other appropriate materials.

In one embodiment of the present invention a 32×202 pixel organization is used, and the pixels are controlled by suitable LCD controller chips. One example of a suitable controller chip is the Epson 1520 available from Epson Corp. The 32×202 organization has been found to be the most economical way to provide a variety of display segments using a minimum of controller chips.

In one embodiment of the present invention one hundred and forty-eight (148) character templates 16 are provided and set forth in an array of four (4) rows and thirty-seven (37) columns. Each template is composed of forty (40) pixels arranged in an array of eight (8) rows and five (5) columns.

Each pixel in a display is addressed using a row and column. The foregoing arrangement of templates and pixels, when used in conjunction with a 32×202 pixel organization, leaves additional addressable space which can be used to display a variety of complementary material. By way of example, lower portion 106 of display screen 10 may be used to display addition text, instructions, or other appropriate icons. This additional material may be etched onto the screen to create further screen interest and contrast.

In one embodiment of the present invention display screen 10 is about 56 mm by 112 mm. The viewing area of the screen is 46 mm by 102 mm.

What is claimed:

1. An individual character template for an alphanumeric display comprising:

an M row by N column pixel matrix providing M*N pixels, each of said N columns having a generally vertical shallow "S" shaped format, the pixels along the center rows of said pixel matrix being substantially square and the pixels along the upper and lower rows of said pixel matrix have corners that define a parallelogram and vertical edges that are curved.

2. The individual character template of claim 1 wherein each of said M rows is horizontal.

3. A character template array for an alphanumeric display comprising:

a plurality of individual character templates said individual character templates deployed in a P row by Q column matrix;

each of said individual character templates formed by pixels deployed in a M row by N column matrix;

a plurality of approximately vertical sinuous traces, there being substantially M*P such traces;

the segment of each vertical trace within any individual character template having a shallow "S" shaped form;

the first and second vertical trace segments in most character templates being connected to the next to the last and last vertical trace segments of the character template in the preceding column of the next lowest character row.

4. The character template array of claim 3 wherein there are one hundred and forty eight individual character templates deployed in four rows and thirty-seven columns.

5. The character template of claim 4 wherein said pixels are energized using liquid crystals.

6. An electrode trace arrangement for generating an array of individual character templates for an alphanumeric display deployed in a P by Q matrix, each individual character template being formed by an M row by N column pixel matrix wherein each N column of said matrix has a generally vertical shallow "S" shaped format, the vertical electrode trace comprising:

a plurality of approximately vertical sinuous traces; there being substantial M*P such traces;

the segment of each of said vertical traces within any character template having a shallow "S" shaped form;

the first and second vertical trace segments in most character templates being connected to the next to the last and last vertical trace segments of the character template in the preceding column of the next lowest character row.

* * * * *